US010750585B2

(12) United States Patent
Secretin

(10) Patent No.: US 10,750,585 B2
(45) Date of Patent: Aug. 18, 2020

(54) DRIVER SYSTEM FOR A LIGHT EMITTING DEVICE

(71) Applicant: SCHREDER S.A., Brussels (BE)

(72) Inventor: Laurent Secretin, Remicourt (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 16/312,849

(22) PCT Filed: Jun. 21, 2017

(86) PCT No.: PCT/EP2017/065304
§ 371 (c)(1),
(2) Date: Dec. 21, 2018

(87) PCT Pub. No.: WO2017/220690
PCT Pub. Date: Dec. 28, 2017

(65) Prior Publication Data

US 2019/0350059 A1 Nov. 14, 2019

(30) Foreign Application Priority Data

Jun. 21, 2016 (EP) ..... 16175512
Jan. 31, 2017 (EP) ..... 17154068

(51) Int. Cl.
*H05B 45/10* (2020.01)
*F21S 2/00* (2016.01)
(Continued)

(52) U.S. Cl.
CPC ..... *H05B 45/10* (2020.01); *F21S 2/005* (2013.01); *F21V 23/0442* (2013.01); *H05B 45/00* (2020.01); *F21Y 2115/10* (2016.08)

(58) Field of Classification Search
CPC . H05B 33/0845; H05B 33/0806; F21S 2/005; F21V 23/0442; F21Y 2115/10
(Continued)

(56) References Cited

U.S. PATENT DOCUMENTS 9,525,486 B2 * 12/2016 Poola ..... H04B 10/116
2012/0043909 A1 * 2/2012 Bloom ..... H05B 33/089 315/294
2013/0039055 A1 * 2/2013 Wilson ..... B60Q 3/74 362/235

FOREIGN PATENT DOCUMENTS

WO 2012148384 A1 11/2012
WO 2014085128 A1 6/2014
WO 2014197782 A1 12/2014

OTHER PUBLICATIONS

PCT International Search Report of the International Searching Authority for corresponding PCT International Application No. PCT/EP2017/065304, dated Sep. 15, 2017, 4 pages.
(Continued)

*Primary Examiner* — Daniel D Chang
(74) *Attorney, Agent, or Firm* — McDonnell, Boehnen, Hulbert & Berghoff LLP

(57) ABSTRACT

A luminaire driver system comprising: a package with input connections for connection to a power supply and output connections for connection to a light emitting device; a predetermined set of circuits arranged in said package; said predetermined set of circuits being adapted to perform a driving functionality of the light emitting device; a receiving means configured for receiving a pluggable module comprising a further circuit, such that the pluggable module can be received from outside of the package, wherein the further circuit is connected to the predetermined set of circuits when the pluggable module is plugged in the receiving means; and connections which are connected to the further circuit when the pluggable module is plugged in the receiving means; wherein the connections are accessible by a user from outside of the package.

22 Claims, 9 Drawing Sheets

(51) Int. Cl.
*F21V 23/04* (2006.01)
*H05B 45/00* (2020.01)
*F21Y 115/10* (2016.01)

(58) Field of Classification Search
USPC ..... 315/362
See application file for complete search history.

(56) References Cited

OTHER PUBLICATIONS

PCT Written Opinion of the International Searching Authority for corresponding PCT International Application No. PCT/EP2017/065304, dated Sep. 15, 2017, 7 pages.

* cited by examiner

FIG. 1 (prior-art)

DRIVER SYSTEM FOR A LIGHT EMITTING DEVICE

CROSS-REFERENCE TO RELATED APPLICATIONS

The present application is a national stage entry of PCT/EP2017/065304 filed Jun. 21, 2017, which claims priority to EP17154068.5 filed on Jan. 31, 2017 and EP16175512.9 filed on Jun. 21, 2016, the contents of each of which are hereby incorporated by reference.

TECHNICAL FIELD

The invention relates to first devices adapted for steering second devices, more in particular said first devices, also denoted drivers, are adapted for providing driving signals for second devices such as light emitting devices (e.g. LEDs).

BACKGROUND

State-of-the-art drivers today provide much more functionality than a basic/primary function providing ordinary on-off driving signals suitable in terms of voltage and/or current for its target light emitting devices (e.g. one or more LEDs). In essence the drivers are today designed to provide a plurality of functionalities and/or are made capable to operate for a plurality of target devices. Unfortunately this evolution results in too bulky and/or costly drivers.

The described capabilities of the state-of-the-art drivers are realized by providing as part of said drivers' architecture a plurality of circuits, typically each matched with a certain (even partly overlapping) functionality, such that when electing a certain use of the drivers (e.g. for a certain target device and a certain mode of operation) most of the other circuits remain available although they are not used. Hence the bulkiness and cost of the drivers do in practice not result in efficient use either.

Besides the fact that a model of driver might be significantly oversized relative to market need, further drawbacks regarding the state-of-the-art can be summarized as below:

Different drivers using different embodiments/connections means that electrical/mechanical integration within the luminaire has to be worked out for each of them.

Different drivers use different electronic circuits, hence electrical/thermal performances related to the basic/primary function have to be evaluated for each of them.

Different drivers use different electronic circuits, hence a certification process (electrical safety/standards compliance) has to be applied for each of them.

SUMMARY

It is the aim of the invention to retain the advantages of the state-of-the art drivers in terms of their enhanced functionality and/or suitability for a large class of target devices while avoiding the above described problem, more particularly the provided invention enables to even further enhance the functionalities and/or broaden the suitability by alleviating the identified size and/or cost barrier and preferably also overcome other drawback of the state-of-the-art.

According to an aspect of the invention, a driver system according to claim 1 is provided.

Preferred embodiments thereof are disclosed in the dependent claims.

An embodiment of the invention is a luminaire driver system, adapted for providing driving signals for a light emitting device of the luminaire, in particular one or more light emitting diodes (LED), comprising connections and a predetermined set of circuits and being modular in that it comprises means to receive one or more further circuits, which can be added in a removable way, at least use of some of the connections is influenceable by the presence and/or the type of the further circuits, wherein the predetermined set of circuits realize a basic driving functionality.

Hence, the invention provides for a driver system being modular, in that an arrangement is provided with a predetermined set of available circuits; and means to receive further circuits, which can be added in a removable way. Although not strictly necessary the predetermined set of available circuits may be selected to be capable to realize a first (basic) driving functionality. This is e.g. switching the light emitting device on, driving it with exactly one light level and switching it off.

The further circuits can be provided as is, i.e. printed on a circuit board. However, it will be more feasible to provide an at least partial housing for the further circuits. A driver system according to the invention then comprises means to receive the further circuits which means are at least partly situated in a housing and/or are part of a housing.

Said means to receive said further circuits may comprise mechanical means (e.g. to actually hold the circuit) and/or electronic means (e.g. to accommodate use of said further circuits). In essence the driver system, when complemented with one or more of said further circuits, is capable to realize one or more driving functionalities different than the first (basic) driving functionality and hence these further circuits are adapted to contribute thereto.

In particular, use of the connections is influenceable by the presence and/or the type of the further circuits, when a signal from the predetermined set of circuits to one or more of the connections is influenceable by the functionality of the further circuits. Influencing the use of the connections can also be provided by the adaptation of the driver to influence or change a signal from the connections to the predetermined set of circuits. The driver can also be adapted to influence the primary function and/or to adapt signals available from primary functions prior to providing the signal to the connector. By way of example a driver system comprising a predetermined set of circuits can be enhanced by being able to provide a dimming functionality once corresponding further circuits are connected to the means to receive the further circuits.

Particularly, a driver system according to the invention comprises connections of which at least one could be used as a connection for a data signal or for a power supply. A data signal may include communication signals, dimming, environmental and/or luminaire specific information. According to another embodiment of the invention a driver system comprises means to supply power to the further circuits and means to connect the further circuits with the predetermined set of circuits. Also the further circuits may provide for a power supply to a device that is connected to the connections, e.g. the light emitting device or a sensor.

Specifically, the driver system according to the invention can be adapted to provide driving signals for different types of light emitting devices. In particular, a driver system according to the invention is adapted to provide driving signals for one or more light emitting diodes. This includes adaptation of the driver system to provide driving signals for one or more laser type LEDs or for organic LEDs. The driver system then comprises a LED driver.

In another but also general embodiment of the invention a luminaire driver system, adapted for providing driving signals for a light emitting device of the luminaire, in particular one or more light emitting diodes (LED), comprises connections and a predetermined set of circuits and is modular in that it comprises means to receive one or more further circuits, which can be added as a pluggable module, whereby at least use of some of the connections is influenceable by the presence and/or the type of the further circuits, wherein the predetermined set of circuits realize a basic driving functionality. The pluggable module may be removable but it can also be fixed to the luminaire driver systems and/or its housing by way of a locking device such that it is not removable without damaging the module or the driver system or its housing.

Recall that state-of-the-art (LED) drivers have multiple functionalities (in terms of embedded features and/or control means) but have the drawback that they are oversized and/or overlapping. The invented (LED) driver is designed in such way that it allows the use of removable connected modules (plug-in, e.g. with use of USB technology) with further circuits as described above. The design of a modular (LED) driver as discussed before however requires many electrical and/or mechanical considerations, going far beyond just placing part of the functional circuits outside the original package of state-of-the-art drivers. The invention is especially practical when the (LED) driver I/O relationships remain preserved (such that the user encounters no problem). Moreover even today state-of-the-art LED drivers require for use of its embedded functionalities that different electric or electronic connections are used. In an embodiment of the invention a fixed I/O relationship is foreseen, which provides an additional user advantage over the state-of-the-art.

In another embodiment of the invention the driver system comprises a preferably separate connector comprising said influenceable connections and allowing the user access to one or more pluggable modules. The driver system can have one or more connectors in the form of slots for making contact with the connections. Using one or more connectors allowing access to the further circuit simplifies the attachment of functional parts like e.g. daylight sensors, cameras or antennae.

Especially, there may be a direct hardware connection between the connector and the further circuits in order to facilitate access to the further circuits. However, this direct hardware connection may comprise simple electric means like a discharge protection to protect the further circuits from misuse.

To avoid that the systems wherein the driver and its target device are used have to change, mechanical form factor aspects must be considered, particularly by use of an enclosure foreseen in a typical package or housing for holding a module. Further, the electrical/thermal performances of the primary function of for instance a LED driver shall also remain preserved whatever the optional use of any pluggable module.

Also, a driver system according to the invention may include means to receive further circuits comprising a biunique fitting mechanism to hold the one or more further circuits, which also helps to avoid misuse of the driver system and the further circuits. However, in another embodiment of the invention the driver system or the further circuits comprise electronic means to adjust the use of the connections depending on the orientation of a coupling device connected to the means to receive further circuits.

Preferably, a driver system according to the invention comprises means to receive one or more further circuits comprising electronic means, in particular to accommodate use of said further circuits. Those means can be adapted to transfer power to the further circuits. They can also include means to identify the one or more further circuits, e.g. by way of a voltage level or signal received on one of the connections between the further circuits and the means to receive the further circuits. Those means for automatic module identification may comprise a resistor so that its voltage level is related to the type of the further circuits. Alternatively, a capacitor or a RFID chip or other chips and tags may be used to receive an information specific for the further circuits.

Alternatively or additionally, the electronic means may be provided as data or signal adaptation means in order to bring the signal from the further circuit within the limits necessary for the predetermined set of circuits. Also, the electronic means may comprise intelligence e.g. a micro processing unit (MPU). Whereas the basic driver system is capable of a simple driving functionality which may be suited for low cost installations, such a basic driver can be enhanced later on for more advanced installations. Also manufacturing of a basic driver system is cheap compared to state of the art driver systems providing all the circuitry for all functionality. According to the invention more ambitious installations can still be based on the same cost efficient driver system being equipped with the further circuits comprising the desired functionality e.g. a micro processing unit (MPU) for receiving and analyzing sensor data.

By way of example a basic driver system may be enhanced with a module for creating a dimming profile. Such a profile may be based on time provided by a real time clock functionality that in turn is provided by the module.

Instead of being part of the driver system with the predetermined set of circuits the electronic means may also be part of the further circuits. By way of example a pluggable module comprising the further circuits may therefore be equipped with a MPU being capable of analyzing pictures taken from a camera being attached to the driver system.

In yet another embodiment of the invention (contrary to state-of-the-art drivers) the driver system comprises further internal circuitry at least recognizing the presence and/or the type. Advantageously, the electronic means comprise this further internal circuitry. The type of the module might be a simple identification number, but it could also be a more in depth definition of the functionality of the module. In particular, the type of the module gives information on the functionality of a module. Recognition can be based on voltage or current level signals.

In such an embodiment of the invention said further internal circuitry after recognizing the type of the module is capable to at least taking the steps to set the right signal switching, in particular for enabling use of said (plugged in) module functionality. In an alternative embodiment the pluggable module is adapted to generate either a recognition signal and/or to perform the right signal switching itself. A recognition signal can be provided through a certain voltage or current.

Other functionalities that may be provided by use of one or more modules are DMX control, DALI control, 0-10 V control, ENOCEAN control, Bluetooth Low Energy (BLE) control, NFC control, Lifi Control, firmware update handling, IR camera daylight sensing, motion sensor and video/image procession, air quality sensing. The module may therefore be capable of creating control signals to the control bus of the driver system if there is a control bus in the basic driver system. Alternatively, the plugged in module can provide bus functionality to the basic driver system.

In a still further embodiment both the above embodiments, generation of a recognition signal and performing the right signal switching itself, are supported. Note that besides providing in one or another way a signal switching, the presence of the intermediate or further circuitry or circuits of the module, may require signal adaptation (e.g. amplification) within either the driver or the module, i.e. the driver or the module comprises means for signal adaptation and in particular, means for signal amplification. It is to be noted that the means for signal adaptation can exist additionally or alternatively on the module side. Also, it is to be noted, that next to or instead of means for signal amplification there may exist means for electrical protection or electrical insulation on the driver or the module side. The pluggable module can there be able to adapt signals from the connections and/or to the connections.

According to another aspect of the invention the driver system comprises one or more pluggable or plugged in modules, a module comprising at least the further circuits. The module is attached to the mechanical means and could be situated within a slot and in a receptacle of a housing of the driver system. There can be another slot corresponding to the first slot to provide space for accommodating a second module. Also, in another embodiment of the invention a receptacle might include space or slots to accommodate two modules. In yet another embodiment the driver system comprises stackable module, at least one module providing means to attach a second module and communicate with it or loop the connection through to the driver system. Accordingly, the driver system is designed to allow the use of two modules simultaneously, which may result in the use of a data bus, preferably SPI or $I^2C$, or separate data connections between each slot and the corresponding circuits of the driver system.

A pluggable module comprises at least the further circuits and preferably also a housing.

In an alternative embodiment of the invention the pluggable module might be provided for bringing additional computing resources, hence offering extra processing power in relation with a certain functionality. Contrary to the analog signal challenges described above, now considerations in relation to digital signal processing come into play, hence one or more of the following circuits such as A/D, digital interfaces, D/A might be required to provide a digital interface to allow interaction between the driver and the module. Also, in order for a driver system already being provided with a MPU it can be advantageous to have a module with an A/D converter if the module is purely analog.

In yet another alternative embodiment of the invention the pluggable module may provide advanced communication functionality (for instance wireless). The driver system must then be adapted to recognize this option such that subsequent functionalities might be enabled accordingly.

Another aspect of the invention is to provide a luminaire with a driver system. Hence, according to another embodiment of the invention there is provided a luminaire with a driver system that is described above or below.

One or more features of the above or below described embodiments may be combined with features of the independent claims to a new embodiment of the invention. Further advantages and aspects of the invention will be described in the schematic drawings.

According to preferred embodiments, the driver system has the features of any one of the following clauses:

1. Luminaire driver system, adapted for providing driving signals for a light emitting device of the luminaire, in particular for a LED, comprising connections and a predetermined set of circuits and being modular in that it comprises means to receive one or more further circuits, which can be added in a removable way, at least use of some of the connections is influenceable by the presence and/or the type of the further circuits, wherein the predetermined set of circuits realize a basic driving functionality.

2. The driver system according to clause 1, wherein the driver system comprises a LED driver.

3. The driver system according to clause 1 or 2 comprising a preferably separate connector comprising said influenceable connections and allowing the user access to one or more of the pluggable modules.

4. The driver system according to any one of the preceding clauses, wherein the means to receive further circuits comprise mechanical means, in particular to hold the one or more further circuits.

5. The driver system according to clause 4, wherein the mechanical means comprise a biunique fitting mechanism to hold the one or more further circuits.

6. The driver system according to any one of the preceding clauses, comprising an enclosure foreseen in a typical package (housing) for holding one or more modules.

7. The driver system according to any of the preceding clauses, wherein the means to receive one or more further circuits comprise electronic means, in particular to accommodate use of said further circuits.

8. The driver system according to clause 7, comprising means for signal adaptation within the driver, in particular means for signal amplification, electrical protection or electrical insulation.

9. The driver system according to clause 7 or 8, comprising further internal circuitry to recognize the presence or the type of a plugged in module.

10. The driver system according to clause 9, wherein the further internal circuitry is capable to at least taking the steps to set the right signal switching, in particular for enabling use of said plugged in module functionality.

11. The driver system according to any one of the preceding clauses, wherein the driver system comprises one or more pluggable or plugged in modules.

12. The driver system according to clause 11, the pluggable module being able to adapt signals from the connections and/or to the connections.

13. The driver system according to clause 11 or 12, wherein the module is adapted to generate either a recognition signal and/or to perform the right signal switching.

14. The driver system according to any one of clauses 11 to 13, wherein the module comprises computing resources.

15. The driver system according to any one of clauses 11 to 13, wherein the pluggable module provides communication functionality, in particular for wireless communication, a D/A circuit, an A/D circuit and/or a digital interface.

16. Luminaire comprising a luminaire driver system according to one of the preceding clauses.

DETAILED DESCRIPTION

In the following, identical features or features that are functioning identically may be described with identical numerals if this is useful.

Figure 1:
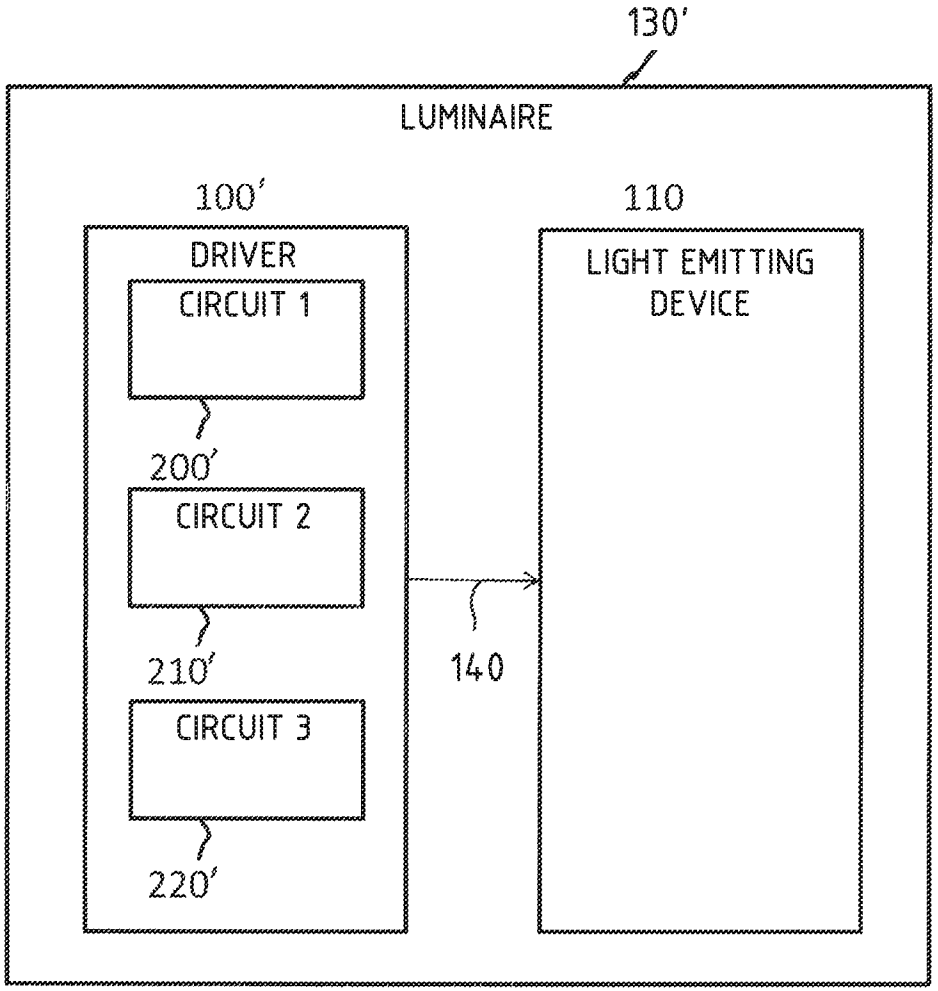
FIG. 1 describes conceptually a state-of-the-art multi-functional driver (100).

FIG. 1 describes conceptually a state-of-the-art multi-functional driver 100' and its target device, a light emitting device 110, e.g. a LED, in a typical arrangement 130' such as a luminaire. The driver 100' comprises a plurality of permanently installed circuits 200', 210', 220'. Arrow 140 indicates the connection of the driver system with the light emitting device 110.

Figure 2:
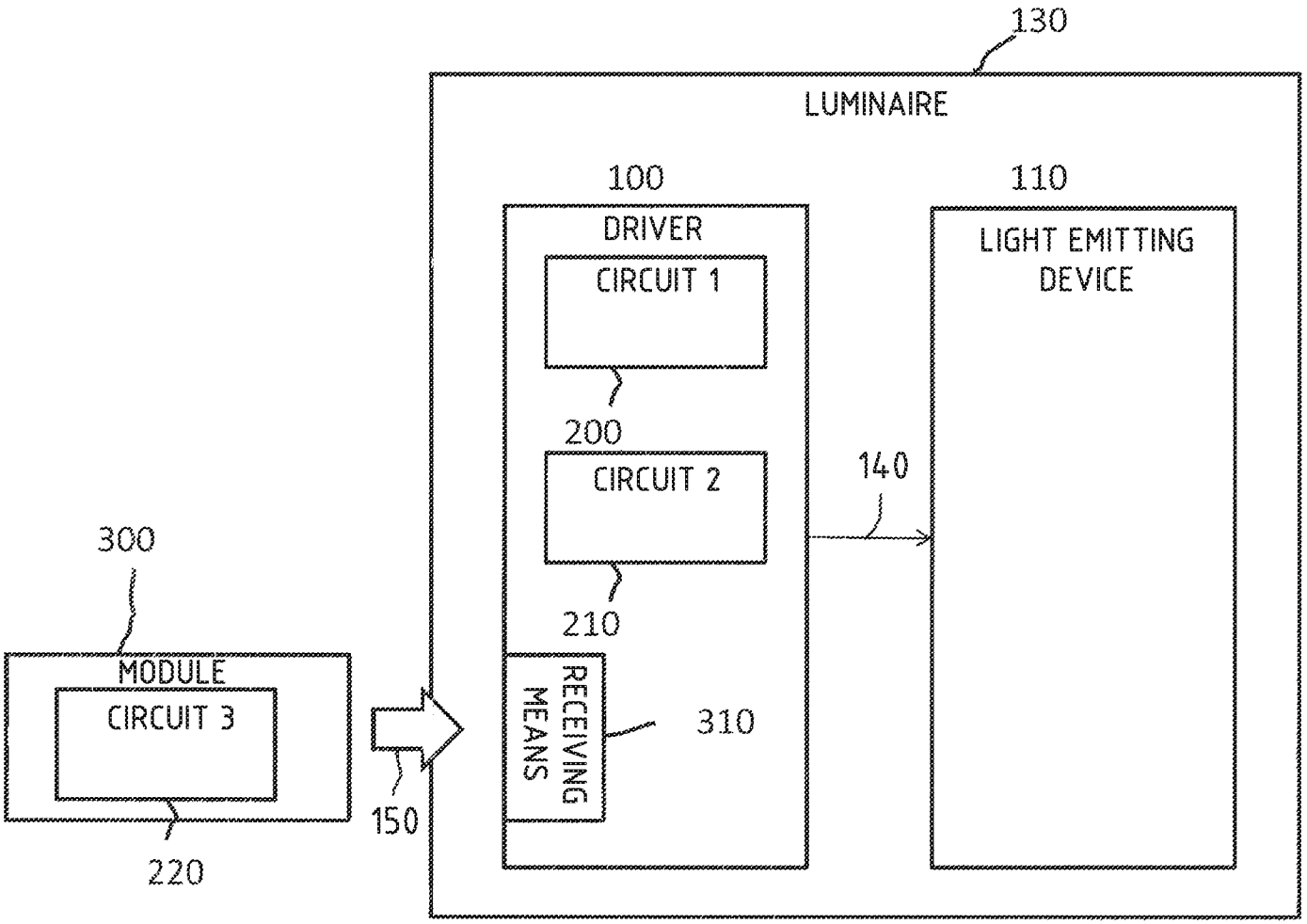
FIG. 2 describes conceptually a multi-functional driver (100) in accordance with the invention.

FIG. 2 describes conceptually a multi-functional driver 100 in accordance with the present invention and in a typical arrangement such as a luminaire 130. Circuits 200, 210 and 220 provide the same functionality as circuits 200', 210', 220'. However, one of the circuits 200, 210 and 220, i.e. circuit 220, is no longer part of the driver but is provided as a removable added further circuit being part of a module 300 while the multi-functional driver 100 is accordingly adapted with a corresponding means 310 in order to receive the module 300. Means 310 include mechanical and electronic means as will be described below. For example, receipt of the module 300 is realized by bringing the module 300 into a slot of the receiving means 310. The process of plugging-in module 300 (in order to attach the further circuitry 220) is indicated by arrow 150.

Note that FIG. 2 is conceptually. In reality, in a preferred embodiment with the original dimension of such multi-functional driver 100 at least an enclosure wherein such one or more modules 300 may fit will be provided. The enclosure may be part of the housing. According to another embodiment of the invention, the enclosure or another part of the basic driver system may also provide a locking device fixing the once added module permanently to the driver system.

The invention also relates to the (pluggable) modules, adapted for providing the required portion of driver functionality and its appropriate dimensions and/or electronic interfacing means. The layout of the predetermined set of drivers of the driver system 100 is not identical to the set of driver system 100' since the circuits of driver system 100 need to be adjusted to provide a basic driving functionality and to be able to integrate with the added further circuits.

Figure 3:
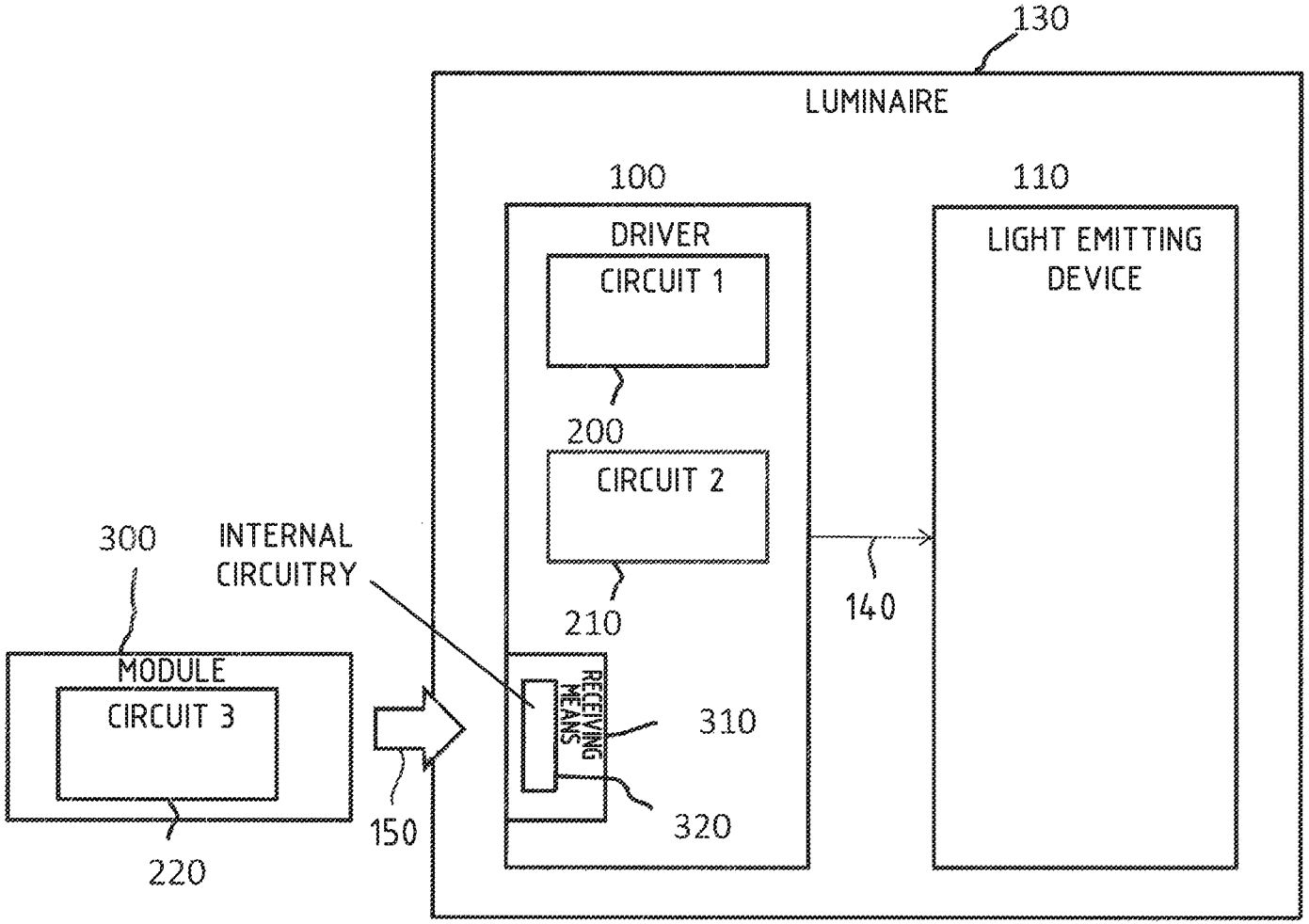
FIG. 3 illustrates an embodiment of the invented driver with more driving functionality.

FIG. 3 illustrates schematically the presence of electronic means to receive the further circuits comprising internal circuitry 320 capable to at least taking the steps to set the right signal switching and/or signal adaptation circuitry within the driver 100. The alternative configurations wherein recognition signal generating circuits and/or signal adaptation circuitry are located in the module 300 are not shown here.

Figure 4:
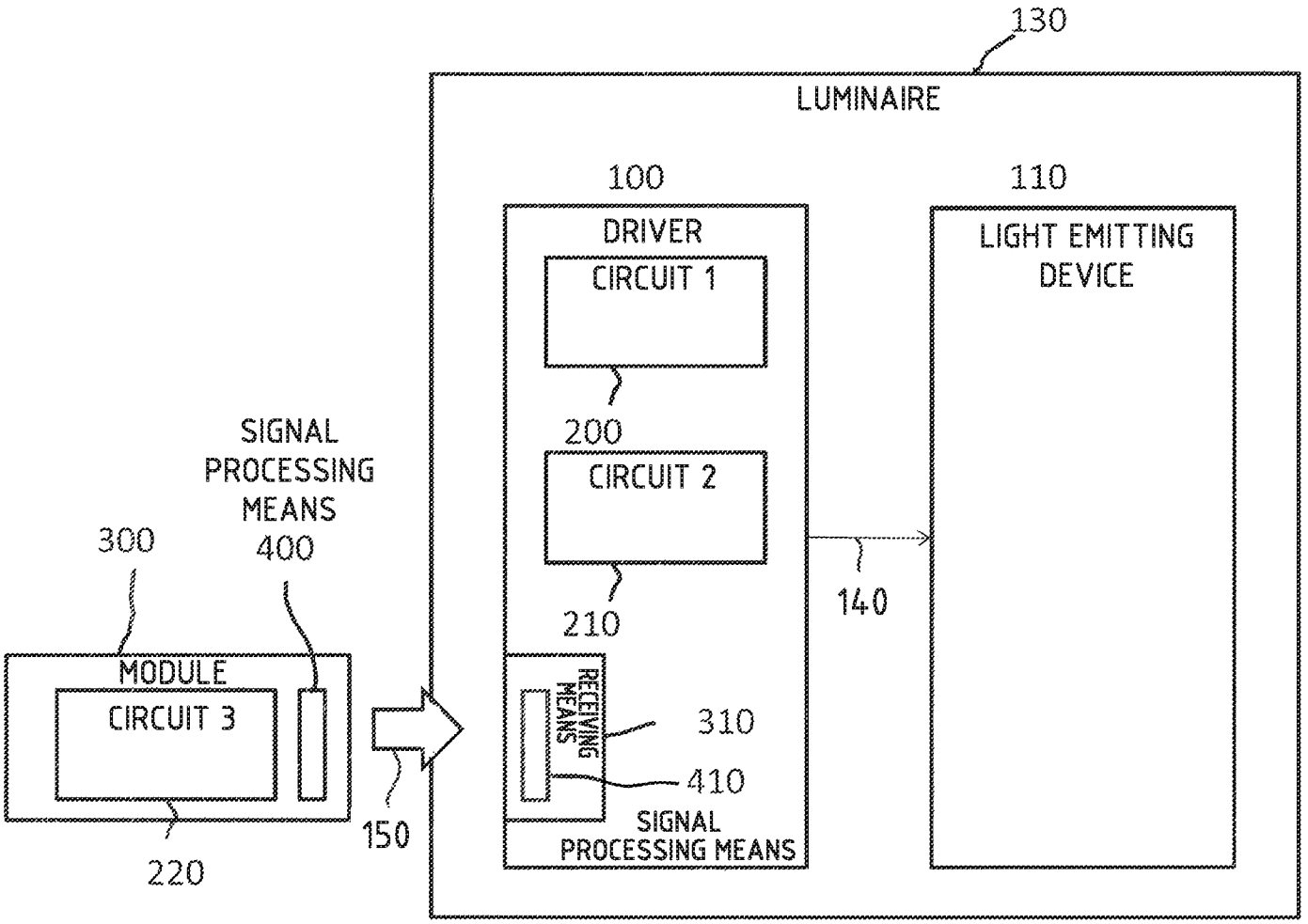
FIG. 4 illustrates an embodiment of the invented driver with more processing functionality.

FIG. 4 illustrates schematically the presence of digital signal processing circuits 400, 410 in said module 300 and driver 100 as electronic means on the driver and on the module side to facilitate communication between the modules. The digital signal processing units might comprise a MPU and/or A/D or D/A converters.

Note that the invention is adapted to enable that the electrical/mechanical integration within the luminaire remains unchanged irrespectively of the selected functionality. Furthermore the invention provides for a solution wherein the electrical/thermal performances related to its functions can be again guaranteed irrespective of the selection functionality, and hence ensuring electrical safety/standards compliance.

Figure 6:
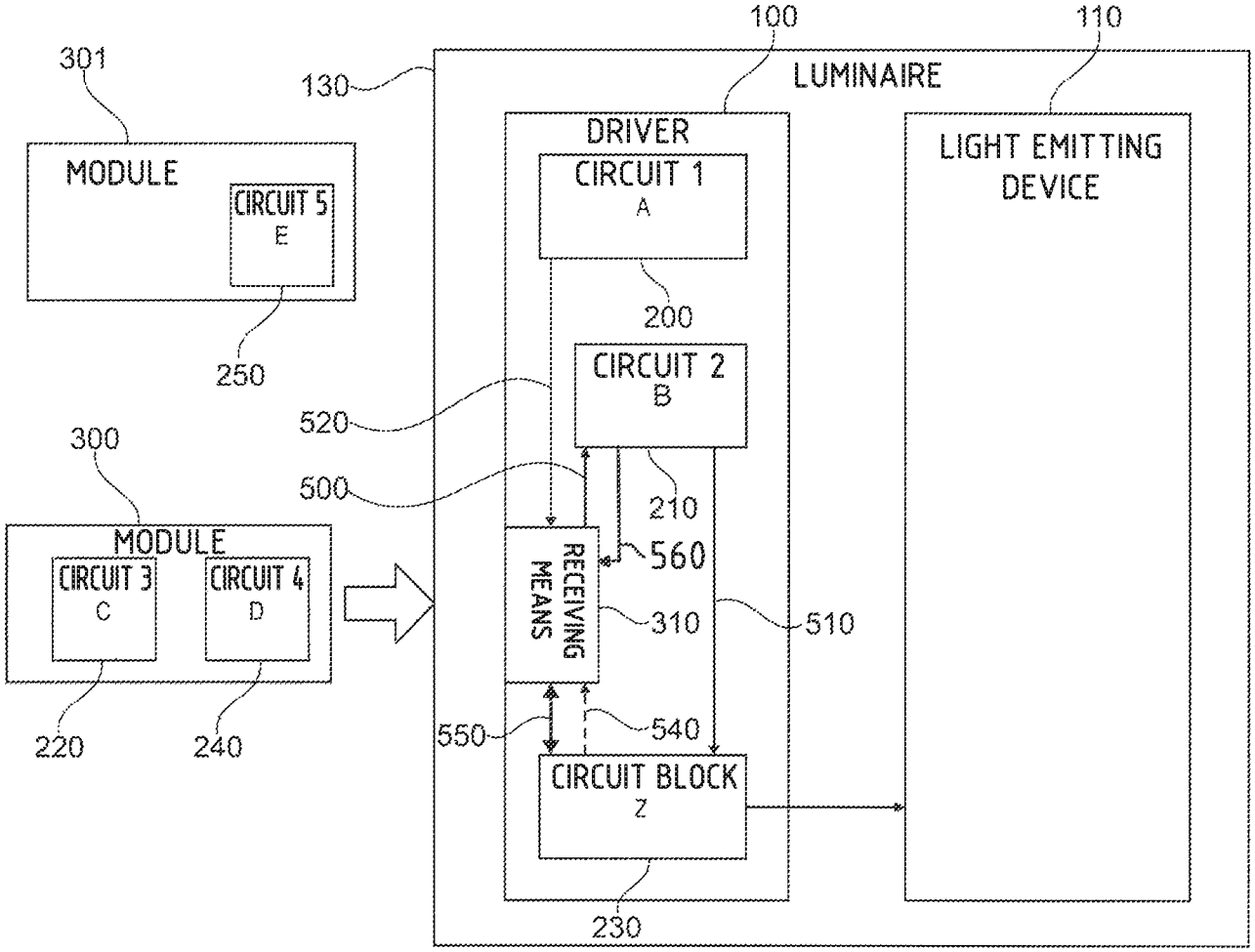
FIG. 6 illustrates an embodiment of the invented driver, including optional functions to be received via multiple external modules.

Note that the figures referred to above only illustrate the use of one external module but the invention also relates to use of a plurality of even quite different modules, as is for instance illustrated in FIG. 6.

A further detailed description of the invention is now further provided below.

Recall that the invention is built on the idea that a driver system 100 such as a LED driver shown in FIG. 6 is at least including some blocks (further called 'A' & 'B' & 'Z' in relation to their function) that are mandatory to ensure the primary function of a LED driver. Some optional blocks might be also part of the LED driver in order to offer some optional functions in addition to the primary function.

Based on such conceptual assumptions the existing prior art might be described as follows: A manufacturer of LED drivers offers a portfolio of drivers. Each model includes the hardware required for the primary functions (A+B+Z). Some models offer a hardware design including one or a plurality of optional functions that are combined with the primary functions (not shown here). Such optional functions might then be enabled or disabled through hardware and/or software means, i.e. for instance a (hardware) switch might be used to enable or disable an optional function instead of just enabling or disabling via only software means.

Contrary to the state-of-the-art an embodiment of the provided invention might be described as follows and is shown in FIG. 6: The LED driver system is designed in such a way that the electronic hardware circuit required to ensure the primary function also includes some electrical/mechanical interconnection means so that an external module can be (at least) partially fitted within the driver to provide one or a plurality of optional functions. Additionally the use of some connections available on the driver (block A or Z) might be influenced by the presence and the type of the external module.

In an exemplary embodiment of the invention the invention provides for a basic LED driver (with building blocks or circuits A, B, Z) but adapted to be able to receive either one or more of additional modules, wherein module 300 (including circuits C and D) when added results in a LED driver with both, 1-10V dimming capability (circuit C) and with DALI dimming functionality (circuit D) and a further module 301 (circuit E) when added results in even more advanced dimming functionality. Alternatively, circuit C or D may also provide real time clock functionality in order to use dimming time dependent dimming profiles.

In a concrete exemplary embodiment function A may relate to the mains input circuitry and connections, function B may relate to voltage to current regulating circuitry while function Z relates to LED output circuitry and connections while the other optional functions C, D, E may respectively relate to 1-10V dimming control circuit, a DALI dimming control circuit and a computing resource to offer automated more advanced dimming functionality.

FIG. 6 illustrates this concept and actually illustrates the different circuits 200, 210, 230 within the driver and their relation e.g. the preserving of the signaling via link 510 of the driving functionality to the light emitting device 110 irrespectively of having a pluggable module. In this embodiment light emitting device 110 is a LED. Moreover, as shown in FIG. 6 the pluggable module 300 may have multiple circuits 220, 240.

Figure 5:
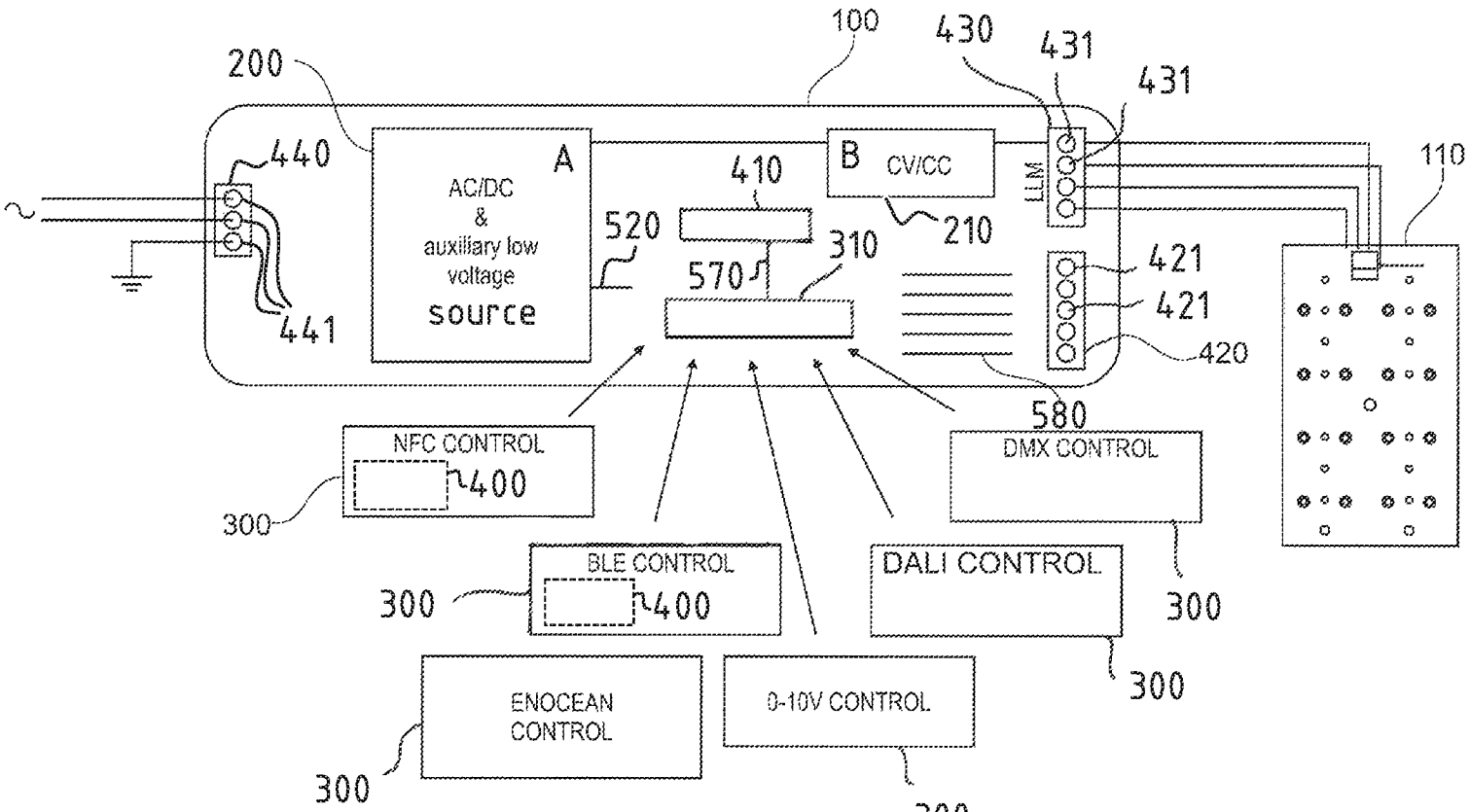
FIG. 5 illustrates an embodiment of the invented driver.

As further illustrated in FIG. 5, the driver 100 comprises a package with input connections 441 of a connector 440 for connection to a power supply, e.g. the mains, and with output connections 431 of a connector 430 for connection to the light emitting device 110. When connected to a power supply, the input connections 441 provide power to input power circuitry 200, and the output connections 431 provide a suitable output signal for driving the light emitting device 110.

FIG. 6 also illustrates that the connection that the receiving means 310—and hence corresponding module 300, 301—has, may be directed to one circuit 210 via signal link 500, and will possibly be focused to control signals as described further, while another circuit 200 may provide the power towards the module 300, 301 via link 520. An alternative powering from circuit Z via signal 540 is also indicated.

Finally, FIG. 6 also illustrates that the use of some connections available on the driver 100, particularly connected to circuit block 230, might be influenced by the presence and the type of the pluggable module 300, 301 via signal 550. Such signals might be bidirectional such that the pluggable modules 300, 301 can adapt signals coming from the connections and/or can adapt signals to be transferred to the connections of the driver circuit block 230. Hence, it is noted that the pluggable module may influence the type of signals available on the connections of the driver 100. Furthermore, the pluggable module 300, 301 may also adapt signals from the connections in order to influence primary function B through link 500, and/or may adapt signals available from primary function through another link 560 prior to making such adapted signal available to the connectors of the circuit block 230 due to the signal relation 550.

Generally the invention may typically overcome oversizing up to more than 50% up to even 70% while offering a driver solution (invented driver and to be used modules) that is in line with customer needs in 60% up to 90% of the cases.

FIG. 5 provides an exemplary embodiment of the invention. FIG. 5 also illustrates some additional aspects, being of interest for all the embodiments of the invention, including as illustrated in FIG. 6.

The first of those additional aspects is to note that most likely the module 300 will have active components and most likely the module 300 will not have its own power source. Hence the multi-functional driver 100 preferably provides a power connection 520 and a power source 200 (power supply input circuitry A with converters to convert power from an external power supply, e.g. the mains, into suitable power signals), adapted in that it can provide power to the internal circuitry of the multi-functional driver 100 but should also be able to deliver a suitable power to the pluggable module (or modules) 300 of various kind. The connection between the LED driver 100 and the pluggable module (or modules) 300 must be able to carry such power signals.

The second of those additional aspects is to emphasize that the contribution of one or more pluggable modules 300, 301 to realize different driving functionalities will typically lie in providing a different control functionality, and hence the signals it generates are typically control signals to the control bus of the driver. Although the modules shown in FIG. 5 each provide different functionality (as disclosed in the corresponding boxes), the different modules are generally depicted with numeral '300'. Functionalities that may be provided for include near field communication control (NFC control), Bluetooth Low Energy control (BLE control), ENOCEAN control, DALI control, DMX control, 0-10 V control. Via receiving means 310 the modules 300 communicate through connection 570 with circuit 410 comprising e.g. control bus functionality and an MPU.

In an exemplary embodiment which may be used in any of the described embodiments the further circuit comprises dimming control circuitry, and preferably any one of the following: DMX (Digital MultipleX) control circuitry, DALI control circuitry, 0-10 V dimming control circuitry. Preferably, the receiving means 310 are configured to receive at least two different types of pluggable modules containing different dimming control circuitry.

In an exemplary embodiment which may be used in any of the described embodiments the further circuit comprises communication circuitry, and preferably any one of the following: ENOCEAN control circuitry, Bluetooth Low Energy (BLE) control circuitry, ZigBee control circuitry, NFC (Near Field Communication) control circuitry, Low-Power Wide-Area Network (LPWAN) circuitry such as LoRa, Sigfox, Narrow-Band Internet of Things (NB-IoT). Preferably, the receiving means are configured to receive at least two different types of pluggable modules containing different communication circuitry.

In an exemplary embodiment which may be used in any of the described embodiments the further circuit comprises a Li-Fi Control circuitry.

In an exemplary embodiment which may be used in any of the described embodiments the further circuit comprises digital signal processing circuitry.

In an exemplary embodiment which may be used in any of the described embodiments the further circuit comprises, firmware update handling circuitry.

In an exemplary embodiment which may be used in any of the described embodiments the further circuit comprises sensor control circuitry, preferably any one of the following: IR camera daylight sensing circuitry, motion sensor and video/image processing circuitry, air quality sensing circuitry, sound sensor.

The third of those additional aspects is to emphasize that the LED driver 100 is preferably constructed in that access by the user to one or more of the pluggable modules 300, 301, is possible without passing through internal circuitry of the LED driver. In FIG. 5 this accessibility is realized by means of a separate connector 420. Connector 420 comprises connections 421 whose functionality changes dependent on the plugged in module 300. The external connections 421 are connected through internal connections 580 to the receiving means 310. Another connector 430 also comprises connections 431 whose use are as well influenceable by the type of module 300 being connected. For instance, connections 431 may provide different levels of power supply according to a dimming level being controlled with one of the modules 300.

Note that in an alternative embodiment the power source might be provided through a separate connector 420 and hence the separate connector 420 and the corresponding connection of the module 300 should then be designed to carry such power signals.

Figure 7:
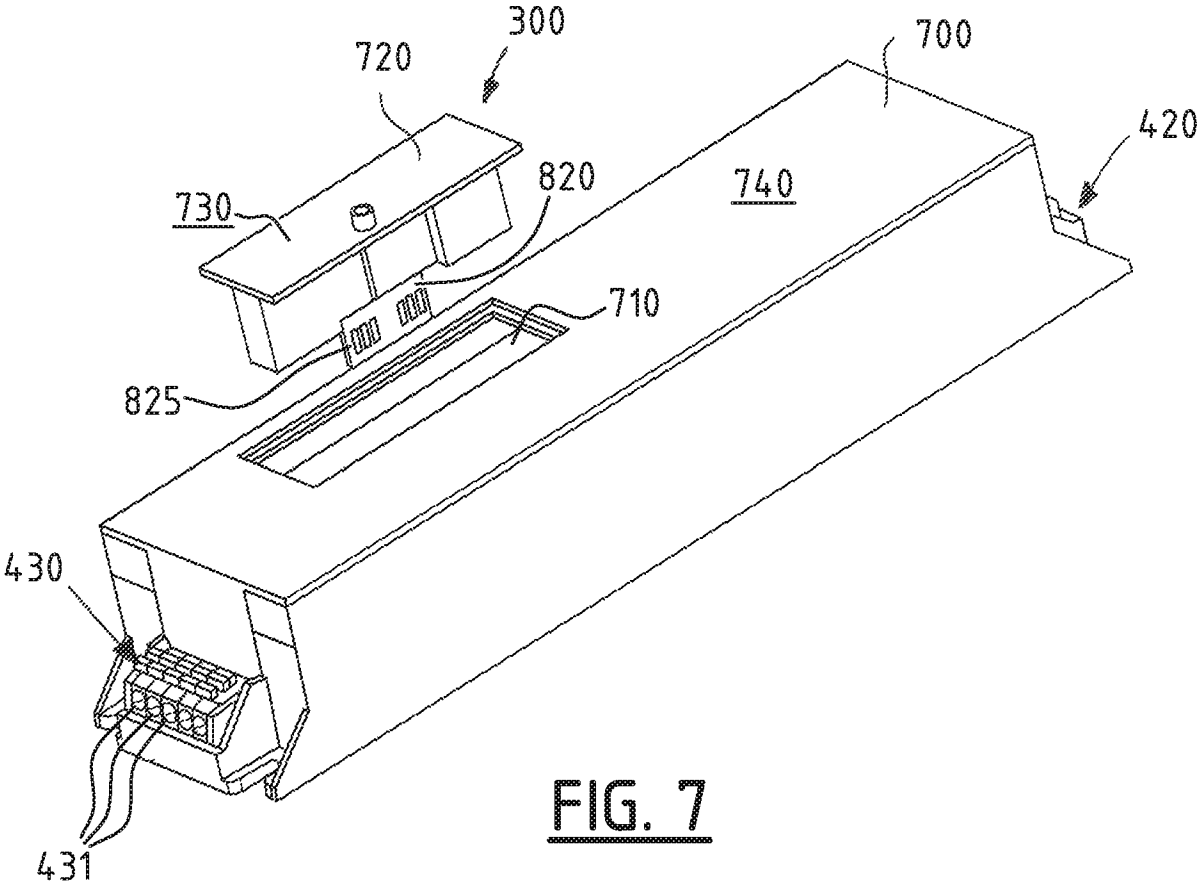
FIG. 7 illustrates a further embodiment of the invented driver, while referring to the concept of a pluggable module in terms of mechanical/electrical integration.

FIG. 7 shows a driver 100 with a housing or package 700 comprising a recess 710 through which a module 300 can be inserted. Preferably, the module 300 has a housing or packaging 720 cooperating with the housing 700 such that the outside surfaces 730 and 740 are flush with each other when the module 300 is installed. Two connectors 420 and 430 comprise respective connections 421 and 431 that are influenced once the module 300 is installed and the driver system is in operation, as has been explained above in connection with FIGS. 5 and 6. Further the housing 700 is provided with a connector (not shown) for connection to a power supply, e.g. the mains.

Figure 8:
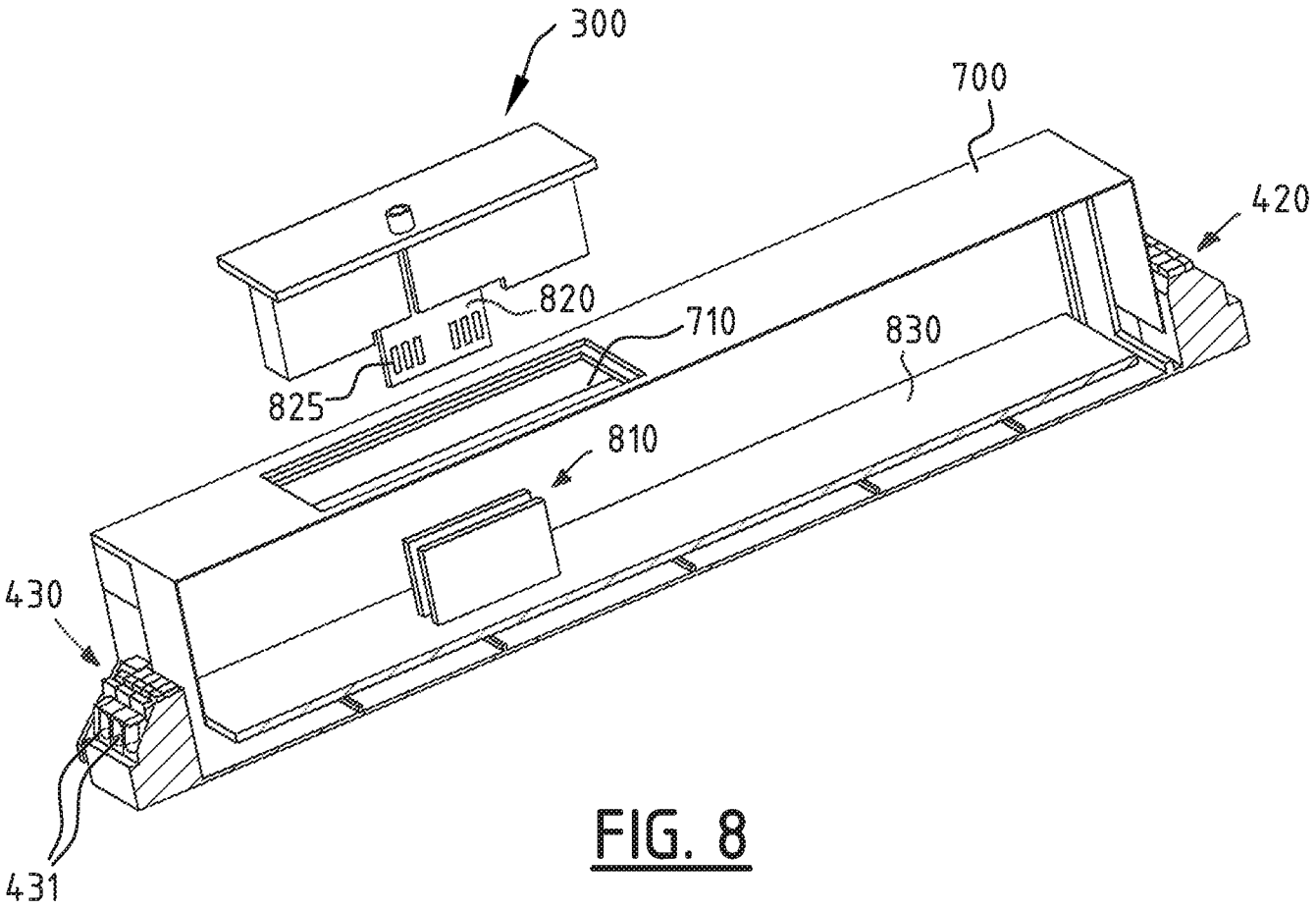
FIG. 8 illustrates a further embodiment of the invented driver, while referring to the concept of a pluggable module in terms of mechanical/electrical integration.

The cross-sectional view of FIG. 8 discloses part of the interior of the housing 700 with a slot 810 receiving the corresponding part of a circuit board 820 with further circuits of module 300. Slot 810 is attached to a circuit board 830 provided at the bottom of housing 700, and comprising a predetermined set of circuits (not shown) for a basic driving functionality. Preferably the slot 810 comprises contact terminals (not visible in FIGS. 7 and 8) and the circuit board 820 of the pluggable module 300 comprises corresponding contact terminals 825 such that the contact terminals of the slot 810 contact the corresponding contact terminals 825 when the pluggable module is plugged in.

Figure 9:
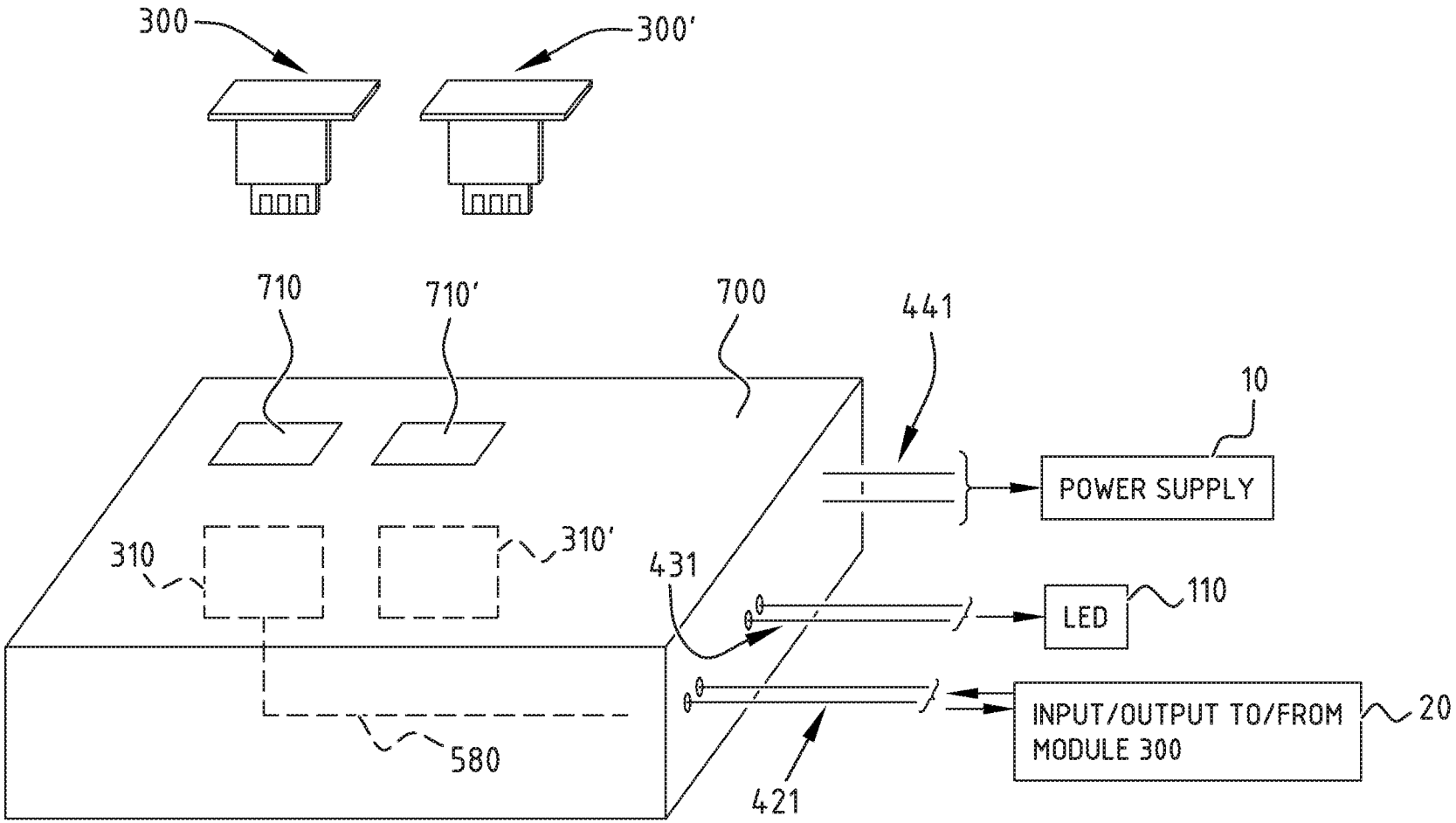
FIG. 9 illustrates another embodiment of the driver according to the invention.

Another driver system according to the invention may comprise means to receive two modules 300. Such an embodiment is illustrated schematically in FIG. 9. The luminaire driver system comprises a package 700 with external input connections 441 for connection to a power supply 10, e.g. the mains, and external output connections 431 for connection to a light emitting device 110. A predetermined set of circuits (not drawn) is arranged in package 700. The predetermined set of circuits are adapted to perform a basic driving functionality of the light emitting device 110, and may comprise mains input circuitry A, voltage to current regulating circuitry B, and LED output circuitry Z. The predetermined set of circuits may be provided on a circuit board (not drawn) in the package 700, e.g. as described in connection with FIGS. 7 and 8.

The package 700 is provided with a first receiving means 310 in package 700. The first receiving means is accessible through a first recess 710 and is configured for receiving a first pluggable module 300 comprising a further circuit, such that the pluggable module 300 can be received from outside of the package 700, through the first recess 710, in the first receiving means 310. The further circuit of module 300 is connected to the predetermined set of circuits arranged in the package 700 when the pluggable module 300 is plugged in the receiving means 310. The package 700 is further provided with a second receiving means 310' configured for receiving a second pluggable module 300' comprising a second further circuit, such that the second further circuit is connected to the predetermined set of circuits when the second pluggable module 300' is plugged in the second receiving means 310'. The second pluggable module 300' is inserted through a second recess 710'.

Preferably, the first receiving means 310 is configured to receive different first types of pluggable modules 300 configured for performing a dimming control function, e.g. a DMX control function, a DALI control function and a 0-10 V dimming control function. In that manner a user can choose whether to use e.g. a DALI control dimming module 300 or a 0-10 V dimming control module 300. Preferably the second receiving means 310' is configured to receive different second types of pluggable modules 300' having a further circuit configured for performing a communication function, e.g. a Bluetooth Low Energy (BLE) control circuitry and a ZigBee control circuitry. In that manner a user can choose whether to use a BLE communication module 300' or a ZigBee communication module 300. The skilled person understands that many other communication protocols exist, and that the module 300' may also include other communication circuitry.

The first and second receiving means 310, 310' may each comprise a slot as described above in connection with FIGS. 7 and 8.

In other embodiments, the different first and second types of modules 300, 300' may be any one or more of the following: DMX (Digital MultipleX) control circuitry, DALI control circuitry, 0-10 V dimming control circuitry, ENOCEAN control circuitry, Bluetooth Low Energy (BLE) control circuitry, ZigBee control circuitry, NFC (Near Field Communication) control circuitry, Low-Power Wide-Area Network (LPWAN) circuitry such as LoRa, Sigfox, Narrow-Band Internet of Things (NB-IoT), Li-Fi Control circuitry, communication circuitry, digital signal processing circuitry, firmware update handling circuitry, IR camera daylight sensing circuitry, motion sensor and video/image processing circuitry, air quality sensing circuitry, sound sensor circuitry.

The package 700 is provided with external connections 421 which are connected (see 580) to the further circuit of module 300 when the first pluggable module 300 is plugged in the first receiving means 310. The connections 421 are accessible by a user from outside of the package. In that manner input and/or output signals 20 can be exchanged between the further circuit of module 300 and a device outside of the package 700, e.g. a control unit controllable by a user. The electrical input/output signals 20 through connections 421 will be different depending on the module 300 that is inserted.

The package 700 may comprise internal circuitry configured to recognize the presence and/or the type of the pluggable module 300 when plugged-in. Alternatively the connections 421 may be connected to a control device capable of recognizing the module 300.

In summary the invention relates to particular carefully considered design architectures for a driver system for a light emitting device, especially for a LED driver, and its corresponding modules taking into account its context (like the luminaire) whereby both functionality, electrical—including (galvanic) isolation- and/or thermal considerations are taken into account. Furthermore the careful consideration in a joint design context of use of additional circuitry to enable the placement outside the original package in terms of costs in view of different use scenarios is notable here. It is worth stressing that the original circuits (remaining in the original package) may typically require change. E.g. a switching circuit selecting between various modes has now to be able to cope with a variable load and/or amount of inputs. Furthermore while the prior art LED drivers may benefit from integration of parts of the functionality in one circuit, now deliberately the overall functionalities are here provided on a sort of board level instead.

The invention claimed is:

1. A luminaire driver system comprising:

a package with input connections for connection to a power supply, output connections for connection to a light emitting device, and separate connections;

a predetermined set of circuits arranged in said package, said predetermined set of circuits being adapted to perform a driving functionality of the light emitting device; and a receiving means configured for receiving a pluggable module comprising a further circuit, such that the pluggable module can be received from outside of the package, wherein the further circuit is connected to the predetermined set of circuits when the pluggable module is plugged in the receiving means;

wherein the separate connections are connected to the further circuit when the pluggable module is plugged in the receiving means, wherein the separate connections are arranged such that they are accessible by a user from outside of the package.

2. The luminaire driver system according to claim 1, wherein the predetermined set of circuits comprises mains input circuitry, voltage to current regulating circuitry, and LED output circuitry.

3. The luminaire driver system according to claim 1, wherein the receiving means are at least partly situated in the package and/or are part of the package.

4. The luminaire driver system according to claim 1, wherein different types of pluggable modules can be plugged-in in the receiving means.

5. The luminaire driver system according to claim 1, wherein the further circuit comprises dimming control circuitry, including any one of the following: DMX (Digital MultipleX) control circuitry, DALI control circuitry, or 0-10 V dimming control circuitry.

6. The luminaire driver system according to claim 5, wherein the receiving means are configured to receive at least two different types of pluggable modules containing different dimming control circuitry.

7. The luminaire driver system according to claim 1, wherein the further circuit comprises communication circuitry, including any one of the following: ENOCEAN control circuitry, Bluetooth Low Energy (BLE) control circuitry, ZigBee control circuitry, NFC (Near Field Communication) control circuitry, or Low-Power Wide-Area Network (LPWAN) circuitry including LoRa, Sigfox, or Narrow-Band Internet of Things (NB-IoT).

8. The luminaire driver system according to claim 7, wherein the receiving means are configured to receive at least two different types of pluggable modules containing different communication circuitry.

9. The luminaire driver system according to claim 1, wherein the further circuit comprises at least one of: a Li-Fi Control circuitry, digital signal processing circuitry, firmware update handling circuitry, sensor control circuitry, IR camera daylight sensing circuitry, motion sensor and video/image processing circuitry, air quality sensing circuitry, or sound sensor circuitry.

10. The luminaire driver system according to claim 1, wherein the package is provided with a recess for receiving the pluggable module, and wherein the pluggable module is removable.

11. The luminaire driver system according to claim 10, therein the recess is provided in a top surface of the package opposite the slot.

12. The luminaire driver system according to claim 1, wherein the predetermined set of circuits is provided on a circuit board in the package.

13. The luminaire driver system according to claim 12, wherein the receiving means comprise a slot provided on the circuit board, said slot being configured to receive a part of a circuit board of the pluggable module.

14. The luminaire driver system according to claim 1, further comprising internal circuitry configured to recognize the presence and/or the type of the pluggable module when plugged-in.

15. The luminaire driver system according to claim 14, further comprising signal switching and/or signal adaption circuitry, wherein the internal circuitry is configured to set the signal switching and/or signal adaption circuitry in function of the recognized type, for enabling use of the plugged-in module.

16. The luminaire driver system according to claim 1, further comprising one or more pluggable or plugged-in modules.

17. The luminaire driver system according to claim 1, further comprising a second receiving means configured for receiving a second pluggable module comprising a second further circuit, such that the second further circuit is connected to the predetermined set of circuits when the second pluggable module is plugged in the second receiving means.

18. The luminaire driver system according to claim 17, wherein the receiving means is configured to receive different first types of pluggable modules configured for performing a dimming control function and wherein the second receiving means is configured to receive different second types of pluggable modules configured for performing a communication function.

19. The luminaire driver system according to claim 1, wherein the receiving means comprises a mechanical means comprising a biunique fitting mechanism configured to hold the pluggable module.

20. The luminaire driver system according to claim 1, wherein the package is provided with a separate connector for realizing the accessibility of the separate connections.

21. A luminaire comprising a luminaire driver system, the luminaire driver system comprising:

a package with input connections for connection to a power supply, output connections for connection to a light emitting device, and separate connections;

a predetermined set of circuits arranged in said package, said predetermined set of circuits being adapted to perform a driving functionality of the light emitting device; and a receiving means configured for receiving a pluggable module comprising a further circuit, such that the pluggable module can be received from outside of the package, wherein the further circuit is connected to the predetermined set of circuits when the pluggable module is plugged in the receiving means;

wherein the separate connections are connected to the further circuit when the pluggable module is plugged in the receiving means, wherein the separate connections are arranged such that they are accessible by a user from outside of the package.

22. A pluggable module configured for use in a luminaire comprising a luminaire driver system, the luminaire driver system comprising:

a package with input connections for connection to a power supply; output connections for connection to a light emitting device and separate connections;

a predetermined set of circuits arranged in said package, said predetermined set of circuits being adapted to perform a driving functionality of the light emitting device;

a receiving means configured for receiving the pluggable module comprising a further circuit, such that the pluggable module can be received from outside of the package, wherein the further circuit is connected to the predetermined set of circuits when the pluggable module is plugged in the receiving means;

wherein the separate connections are connected to the further circuit when the pluggable module is plugged in the receiving means, wherein the separate connections are arranged such that they are accessible by a user from outside of the package.

* * * * *